US005726400A

United States Patent [19]

Masuda

[11] Patent Number: 5,726,400

[45] Date of Patent: Mar. 10, 1998

[54] THIN SWITCH

[75] Inventor: Masazi Masuda, Shizuoka, Japan

[73] Assignee: Fuji Electronics Industries, Ltd., Shizuoka, Japan

[21] Appl. No.: 677,090

[22] Filed: Jul. 9, 1996

[30] Foreign Application Priority Data

Jul. 12, 1995 [JP] Japan ..... 7-199149

[51] Int. Cl.[6] ..... H01H 13/00

[52] U.S. Cl. ..... 200/16 D; 200/1 R

[58] Field of Search ..... 200/1 R, 5 R, 200/5 A, 5 C, 16 R–16 D, 18, 402, 405, 406, 467, 512, 513, 516, 517, 520, 530, 537, 445, 341

[56] References Cited

U.S. PATENT DOCUMENTS

| | | | |
|---|---|---|---|
| 4,197,437 | 4/1980 | Michalski | 200/67 D |
| 4,359,614 | 11/1982 | Green et al. | 200/5 R |
| 4,385,218 | 5/1983 | Nishida | 200/159 B |
| 4,771,139 | 9/1988 | DeSmet | 200/5 A |
| 5,343,008 | 8/1994 | Ipcinski | 200/302.2 |

*Primary Examiner*—Cassandra C. Spyrou
*Assistant Examiner*—Michael A. Friedhofer
*Attorney, Agent, or Firm*—Flynn, Thiel, Boutell, & Tanis, P.C.

[57] ABSTRACT

A compact, thin switch of a simple contact structure to be operated for switching operations by an external pressure comprises a base, four stationary contacts arranged on the base and isolated from each other, a curved, self-resetting first movable contact plate formed of a conductive spring material, and mounted on the base, and a curved, second movable contact plate formed of a conductive spring material, and put on top of the first movable contact plate. The first movable contact plate is disposed opposite to the stationary contact with one end thereof in permanent contact with the stationary contact and the concave surface thereof facing the stationary contact so as to be brought into contact with the stationary contact, the second movable contact plate is disposed with its concave surface in permanent contact with the convex surface of the first movable contact plate, one end thereof in permanent contact with the stationary contact and the other end thereof in contact with the stationary contact so as to be able to be separated from the stationary contact make the first movable contact plate and the second movable contact plate yield to curve convexly in the opposite direction is applied to the second movable contact plate so that the first movable contact plate comes into contact with the stationary contact and the other end of the second movable contact plate is separated from the stationary contact.

10 Claims, 9 Drawing Sheets

A–A

B-B

THIN SWITCH

BACKGROUND OF THE INVENTION

1. Field of the Invention

The present invention relates to a thin switch having a plurality of contacts, a first movable contact plate and a second movable contact plate, and capable of changing the mode of contact of the first and the second movable contact plate with the plurality of contacts when an external pressure is applied thereto.

2. Description of the Related Art

A micro switch, such as a limit switch, is provided with a snap-action mechanism. The micro switch responds to very small movements of its actuator caused by an external pressure applied to the actuator and changes in a snap action from one contact position in which a movable contact plate is in contact with one of two stationary contacts to the other in which the movable contact plate is in contact with the other stationary contact. The micro switch of this construction needs a snap-action spring for causing a snap action in the direction of action of the pressure. Therefore, it has been difficult to reduce the dimension of such a micro switch along the contact changing direction. In an assembling process for assembling the micro switch, the movable contact plate needs to be handled with the snap-action spring strained between the movable contact plate and a support member for supporting the movable contact plate, the assembling process needs many steps, and automatic assembling of the micro switch has been substantially impossible.

SUMMARY OF THE INVENTION

Accordingly, it is an object of the present invention to provide a thin switch provided with a simple contact structure that is operated by an external pressure, having a small thickness and a small size, and facilitating assembling work for assembling the same.

With the foregoing object in view, the present invention provides a thin switch to be operated by an external pressure for switching operations comprising: a base; four stationary contacts fixedly arranged in the base and isolated from each other; a curved, self-resetting first movable contact plate formed of a conductive spring material, and mounted on the base with one end thereof in permanent contact with the stationary contact so as to come into contact with the stationary contact; and a curved, self-resetting second movable contact plate formed of a conductive spring material, and put on top of the first movable contact plate in permanent contact with the first movable contact plate with one end thereof being in permanent contact with one stationary contact and the other end thereof being in contact with another stationary contact so as to be able to be separated from the same stationary contact.

When an external pressure exceeding the rigidity of the first movable contact plate is applied to the second movable contact plate, the first and the second movable contact plate yield to the external pressure to curve convexly in the opposite direction. Consequently, the first movable contact plate comes into contact with the stationary contact which is separated from the first movable contact plate, maintaining the contact with the second movable contact plate when no pressure is applied to the second movable contact plate, and the end of the second movable contact plate is disconnected from the stationary contact which is in contact with the end of the second movable contact plate when no pressure is applied to the second movable contact plate.

When an insulator is interposed between the first and the second movable contact plate, the switching operation can be achieved while the first and the second movable contact plate are kept electrically isolated from each other.

The thin switch in accordance with the present invention can easily be assembled by sequentially superposing the first and the second movable contact plate on the stationary contacts arranged in the base. Since the first movable contact plate is capable of storing energy to recover its original form, any special spring for snap actions is unnecessary and the switch has a simple construction and a relatively small thickness.

DETAILED DESCRIPTION OF THE PREFERRED EMBODIMENTS

First Embodiment

Figure 1:
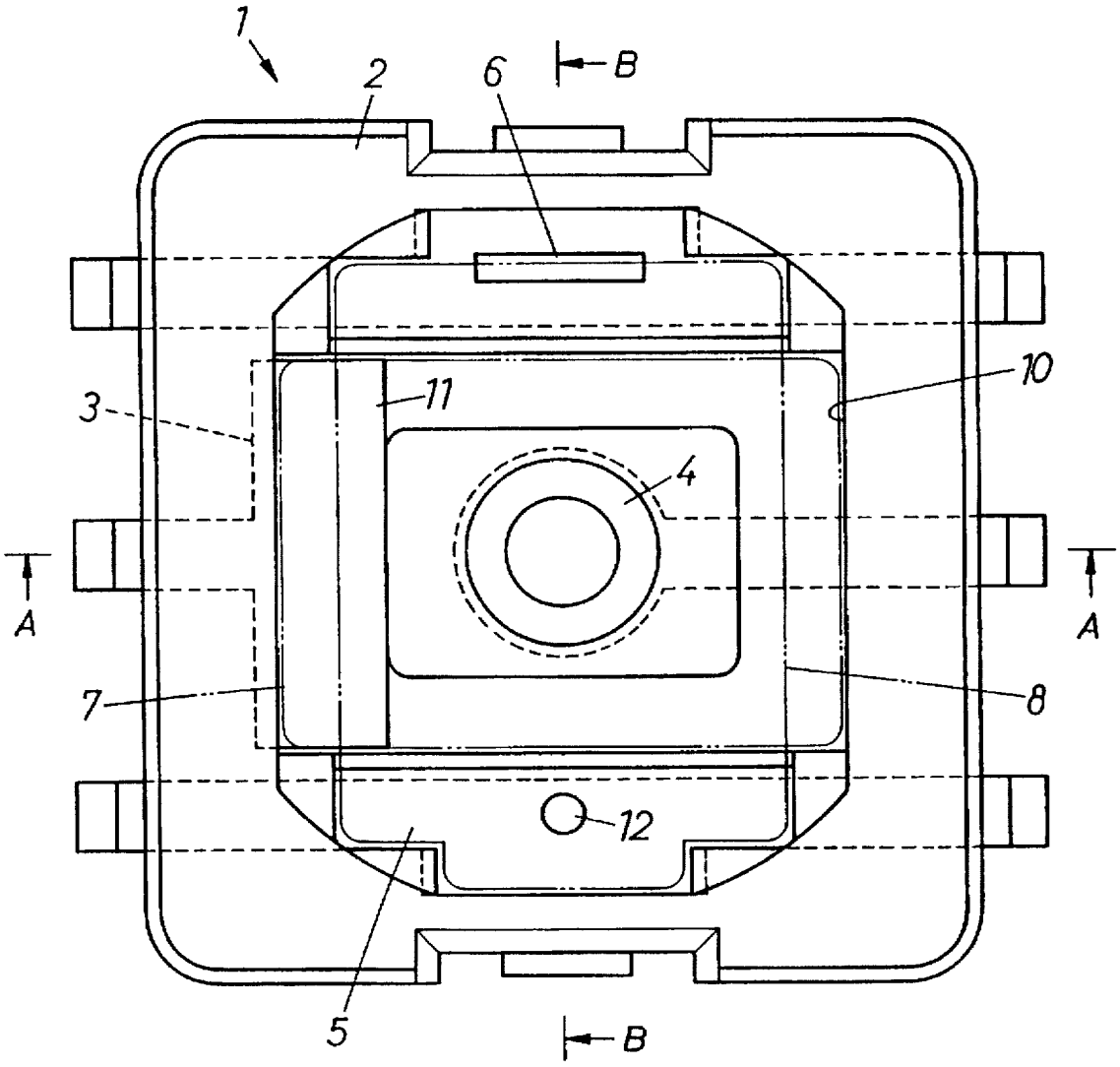
FIG. 1 is a plan view of a base and stationary contacts included in a thin switch in the preferred embodiment according to the present invention.
Figure 2:
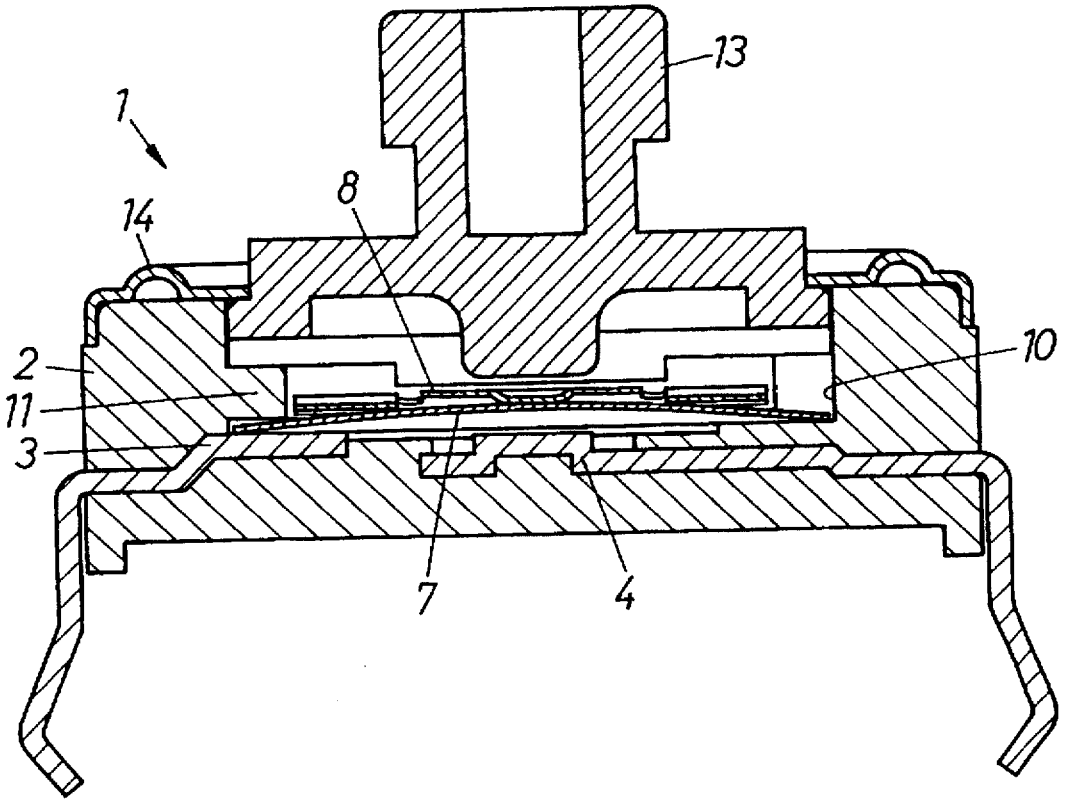
FIG. 2 is a sectional view taken on line A—A in FIG. 1.
Figure 3:
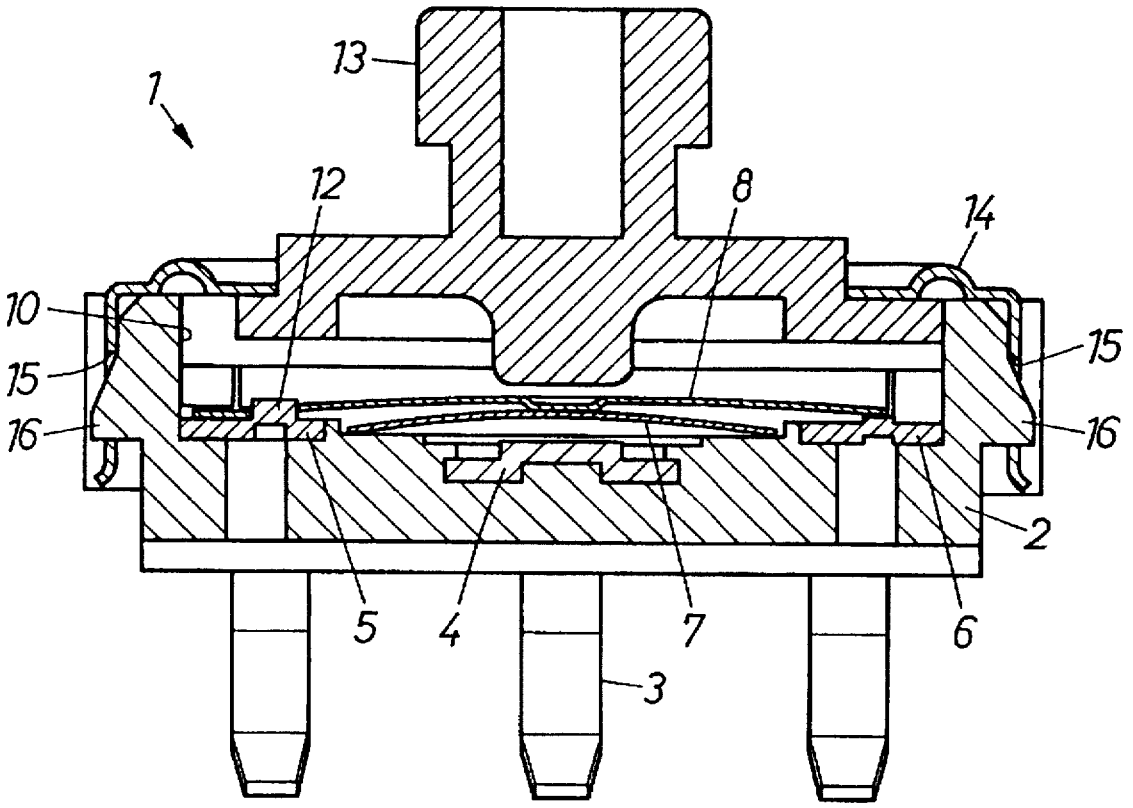
FIG. 3 is a sectional view taken on line B—B in FIG. 1.

Referring to FIGS. 1 to 3 showing a thin switch 1 in a first embodiment according to the present invention, the thin switch 1 is assembled by arranging four stationary contacts 3, 4, 5 and 6 in a base 2 in an electrically isolated arrangement, placing a first movable contact plate 7 and a second movable contact plate 8 in that order in the base 2 over the stationary contacts 3, 4, 5 and 6.

The base 2 is formed of an insulating material, such as a plastic material, and is provided with a substantially rectangular recess 10 opening upwardly from its upper surface. The stationary contacts 3, 4, 5 and 6, which serve also as terminals to which wiring lines are connected, are fixedly united with the base 2 by an insert molding process, electrically isolated from each other and exposed in the recess 10. In this embodiment, the stationary contact 3 is disposed on the side of one of the longer sides of the recess 10, the stationary contact 4 is extended across the other longer side of the recess 10 and it has a circular end exposed in the central region of the recess 10. The stationary contact 5 has a transversely elongate shape and is disposed on the side of one of the shorter side of the recess 10, and the stationary contact 6 has a transversely elongate shape and is disposed on the side of the other shorter side of the recess 10.

Figure 4:
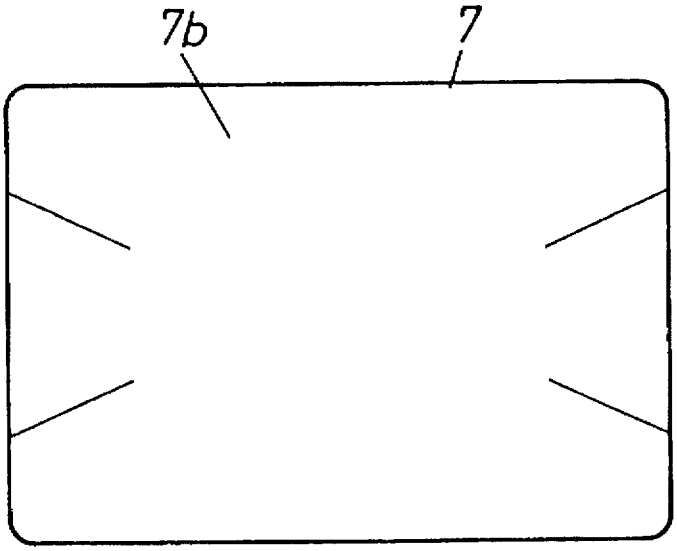
FIG. 4 is a plan view of a first movable contact plate included in the thin switch of the present invention.
Figure 5:
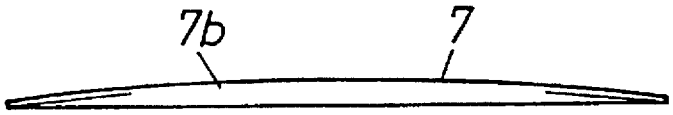
FIG. 5 a side view of the first movable contact plate of FIG. 4.
Figure 6:
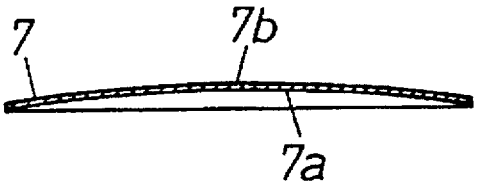
FIG. 6 is a sectional view of the first movable contact plate of FIG. 4.

Referring to FIGS. 4 to 6 concretely showing the first movable contact plate 7, the first movable contact plate is formed of a conductive spring material in a generally rectangular shape in a plane. Four creases are formed in the first movable contact plate 7 by pressing (beading) so as to extend in parallel to the diagonals from the pair of shorter edges, respectively, of the first movable contact plate 7 to form the first movable contact plate 7 in a curved shape having a concave surface 7*a* and a convex surface 7*b* and substantially resembling a portion of a spherical surface. The first movable contact plate 7 has a rigidity that withstands pressures below a certain limit pressure. The first movable contact plate 7 yields and warps convexly in the opposite direction when a pressure exceeding the limit pressure is applied thereto and restores its original shape automatically when the pressure is removed therefrom.

The first movable contact plate 7 is placed in the recess 10. One edge portion of the first movable contact plate 7 is depressed by a projection 11 formed integrally with the base 2 so as to be kept in permanent contact with the stationary contact 3. Normally, the lower concave surface 7*a* faces and is separated from the central fixed contact 4. The first movable contact plate 7 comes into contact with the central fixed contact 4 when an external pressure is applied thereto. Another edge portion of the first movable contact plate 7 opposite the edge portion depressed by the projection 11 is free to move vertically in the recess 10.

Figure 7:
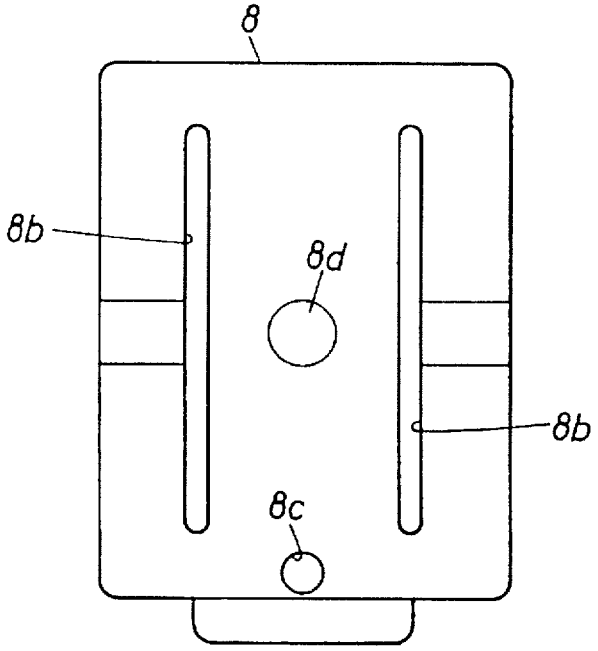
FIG. 7 is a plan view of a second movable contact plate included the thin switch of the present invention.
Figure 8:
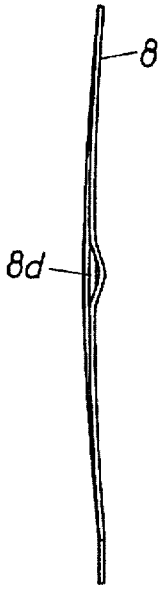
FIG. 8 is a side view of the second movable contact plate of FIG. 7.
Figure 9:
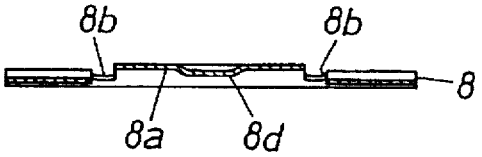
FIG 9 is a sectional view of the second movable contact plate of FIG. 7.

Referring to FIGS. 7 to 9 concretely showing the second movable contact plate 8, the second movable contact plate 8 is formed of a conductive spring material in a generally rectangular shape in a plane. The second movable contact plate 8 is provided with two slits 8*b* formed, for example, in parallel to the longer edges thereof, and the respective middle sections of striplike portions of the second movable contact plate 8 extending on the outer side of the slits 8*b* are curved in the shape of a circular arc to reduce the length along the longer edges so that a portion of the second movable contact plate 8 extending between the slits 8*b* is capable of a snap action. The second movable contact plate 8 is provided with a through hole 8*c* formed adjacent one shorter edge thereof, and a contact protrusion 8*d*, which is to be in contact with the convex surface 7*b* of the first movable contact plate 7, formed in its lower concave surface 8*a*. In this embodiment, the second movable contact plate 8 is of a bistable type and is capable of stabilizing in an upward convex shape in the normal state where no external pressure is applied to an actuator 13 as shown in FIG. 9, or being warped into a downward convex shape by an external pressure and stabilizing in the downward convex shape after the external pressure has been removed therefrom.

The second movable contact plate 8 is placed on the first movable contact plate 7 in the recess 10 with a fixed projection 12 formed integrally with the stationary contact 5 fixedly fitted in the through hole 8 (FIG. 3). Consequently, the second moveable contact plate 8 is in permanent contact with the stationary contact 5 at the fix projection 12 and through hole 8*c*, and is in permanent contact with the convex surface 7*b* of the first movable contact plate 7 at its central contact protrusion 8*d*. Normally, the second movable contact plate 8 is in contact with the stationary contact 6. When caused to yield to warp convexly in the opposite direction, the second movable contact plate 8 separates from the stationary contact 6.

Thus, the first movable contact plate 7 and the second movable contact 8 are curved in the same direction and disposed so as to extend across each other. The actuator 13 is fitted in the recess 10 so as to be movable in a direction to depress the first movable contact plate 7 and the second movable contact 8. The actuator 13 is held so as not to fall off by a cover 14 attached to the base 2. When attaching the cover 14 to the base, the side wall of the cover 14 is distorted elastically so that projections 16 formed on the side surface of the base 2 fall into holes 15 formed in the side wall of the cones and hold the cover 14 firmly in place.

Figure 10:
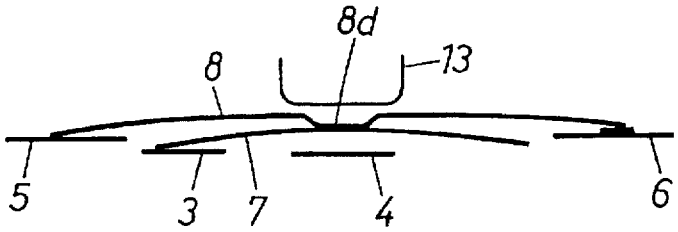
FIG. 10 a diagrammatic view for assistance in explaining the positional relation between stationary contacts, and the first and the second movable contact plates are in a state where no pressure is applied to the first movable contact plate.
Figure 11:
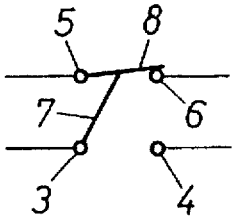
FIG. 11 a diagrammatic view for assistance in explaining electrical contact between the stationary contacts, and the first and the second movable contact plates are in a state where no pressure is applied to the first movable contact plate.

As shown in FIGS. 10 and 11, in the normal state where no external pressure is applied to the actuator 13, the first movable contact plate 7 is in electrical contact with the stationary contact 3 and in contact with the contact protrusion 8*d* of the second movable contact plate 8, and the second movable contact plate 8 is in contact with the first movable contact plate 7 and the stationary contacts 5 and 6. Consequently, the stationary contacts 3, 5 and 6 are electrically connected to each other, and the stationary contact 4 is isolated from other stationary contacts 3, 5 and 6.

Figure 12:
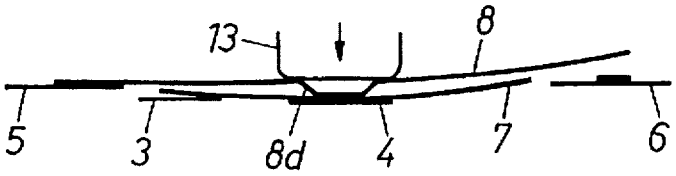
FIG. 12 is a diagrammatic view for assistance in explaining the positional relation between the stationary contacts, and the first and the second movable contact plates are in a state where a pressure is applied to the first movable contact plate.
Figure 13:
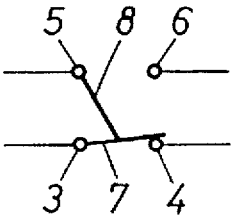
FIG. 13 is a diagrammatic view for assistance in explaining electrical contact between the stationary contacts, and the first and the second movable contact plates are in a state where a pressure is applied to the first movable contact plate.

As shown in FIGS. 12 and 13, when an external pressure exceeding the rigidities of the first movable contact plate 7 and the second movable contact plate 8 is applied to the actuator 13, the first movable contact plate 7 and the second movable contact plate 8 yield to warp convexly in the opposite direction. The moment the first movable contact plate 7 and the second movable contact plate 8 yield to warp convexly in the opposite direction, the resistance against the external pressure decreases sharply, whereby the operator is able to feel a switching motion.

When the first movable contact plate 7 and the second movable contact plate 8 have thus been warped convexly in the opposite direction, the first movable contact plate 7 is in contact with the stationary contact 3 and comes into contact with the stationary contact 4, the second movable contact plate 8 is in contact with the stationary contact 5 and separates from the stationary contact 6. Consequently, the stationary contacts 3, 4 and 5 are connected electrically to each other and the stationary contact 6 is isolated from the stationary contacts 3, 4 and 5. When the external pressure is removed from the actuator 13, the first movable contact plate 7 restores its original form by its own resilience, allowing the second movable contact plate 8 to restore its original shape by its own capability of a snap action. Thus, the stationary contacts 3 and 5 are kept in permanent electrical connection to each other while being selectively connected to the stationary contact 4 when the external pressure is applied to the actuator 13 or to the stationary contact 6 when the external pressure is removed from the actuator 13.

Second Embodiment

FIGS. 14 to 17 show a thin switch in a second embodiment according to the present invention, in which component parts like or corresponding to those of the first embodiment are designated by the same reference characters and the description thereof will be omitted. While the first movable contact plate 7 and the second movable contact plate 8 are in permanent electrical contact with each other in the first embodiment, the first movable contact plate 7 and the second movable contact 8 are permanently separated from each other by an insulating member 9 interposed between the first movable contact plate 7 and the second movable contact plate 8 in the second embodiment.

Figure 14:
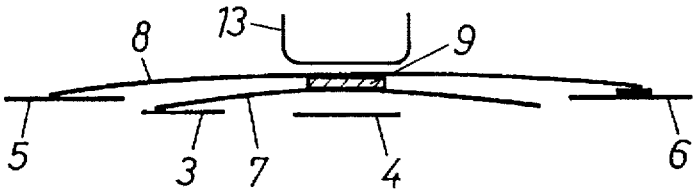
FIG. 14 is diagrammatic view for assistance in explaining the positional relation between stationary contacts, and first and second movable contact plates in a thin switch in a second embodiment according to the present invention.
Figure 15:
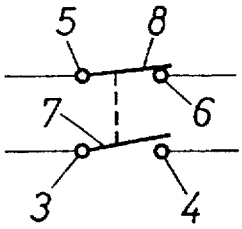
FIG. 15 is a diagrammatic view for assistance in explaining electrical contact between the stationary contacts, and the first and the second movable contact plates are in a state where no pressure is applied to the first movable contact plate.
Figure 16:
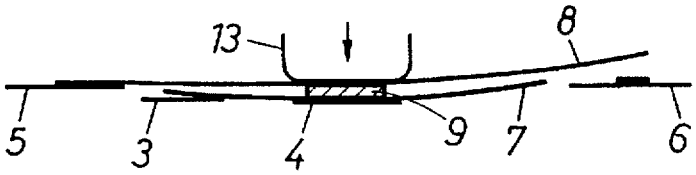
FIG. 16 is a diagrammatic view for assistance in explaining the positional relation between the stationary contacts, and the first and the second movable contact plates are in a state where a pressure is applied to the first movable contact plate.
Figure 17:
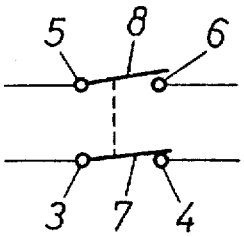
FIG. 17 is a diagrammatic view for assistance in explaining electrical contact between the stationary contacts, and the first and the second movable contact plates are in a state where a pressure is applied to the first movable contact plate.

In the normal state where no external pressure is applied to the actuator 13, the first movable contact plate 7 is not in contact with both the stationary contact 4 and the second movable contact plate 8, and the second movable contact plate 8 is in contact with the stationary contacts 5 and 6 as shown in FIGS. 14 and 15.

When an external pressure is applied to the actuator 13 to make the first movable contact plate 7 and the second movable contact plate 8 warp convexly in the opposite direction, the first movable contact plate 7 comes into contact with the stationary contact 4, and the second stationary contact plate 8 separates from the stationary contact 6. When the external pressure is removed from the actuator 13, the first movable contact plate 7 and the second movable contact plate 8 are restored to their original shapes by the resilience of the first movable contact plate 7. The first movable contact plate 7 and the second movable contact plate 8 are interlocked for the switching operation and are electrically separated from each other.

Other Embodiments

Figure 18:
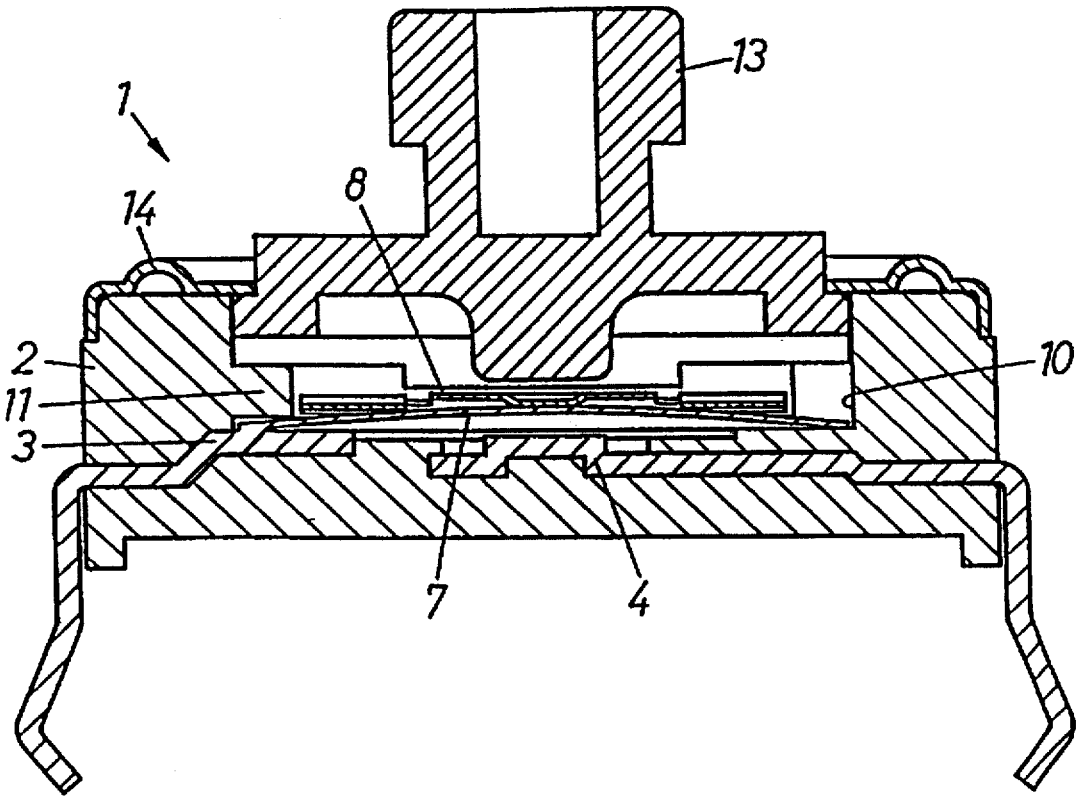
FIG. 18 is a view similar to FIG. 2 showing a third embodiment.
Figure 19:
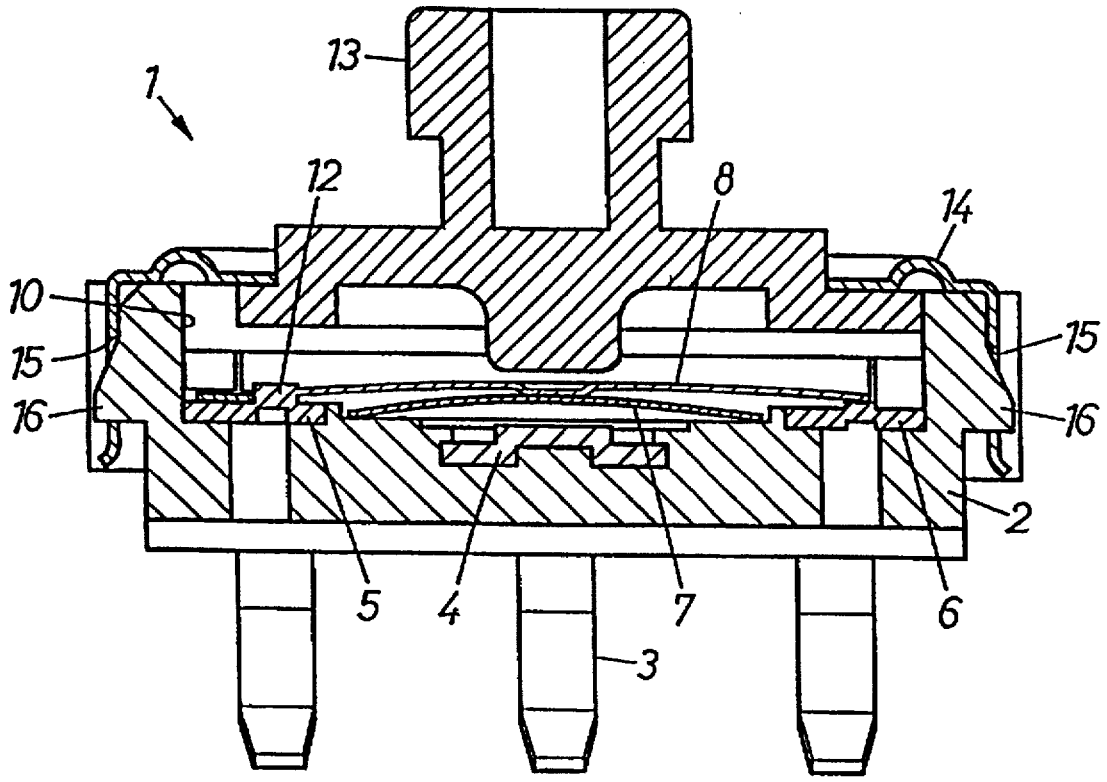
FIG. 19 is a view similar to FIG. 3 showing the third embodiment.

Since the first movable contact plate 7 and the second movable contact plate 8 are always in permanent contact with the stationary contacts 3 and 5, respectively, and electrically connected to each other, the first movable contact plate 7 and the second movable contact plate 8 may each be substituted for a single movable contact plate having the same functions of the first movable contact plate 7 and the second movable contact plate 8, i.e. the first movable contact plate 7 and stationary contact 3 are a single conductive plate (FIG. 18) and the second movable conductive plate 8 and stationary contact 5 are a single conductive plate (FIG. 19). The actuator 13 may be omitted, the cover 14, for example, may be substituted by an elastically deformable cover, and the external pressure may be applied through the elastically deformable cover to the first movable contact plate 7 and the second movable contact plate 8. The second movable contact plate 8 of a bistable type may be substituted by a movable contact plate similar to the first movable contact plate 7 capable of restoring its original shape by its own resilience.

What is claimed is:

1. A thin switch comprising:

a base;

four stationary contacts arranged on the base and being isolated from each other;

a curved, self-resetting first movable contact plate formed of a conductive spring material, the first contact plate being mounted on the base and being curved in a first direction;

a curved, second movable contact plate formed of a conductive spring material, the second contact plate being placed on top of the first contact plate and being curved in the first direction;

the first contact plate having a first end in permanent contact with a first of the four stationary contacts the second contact plate being in permanent contact with the first contact plate and having first and second ends, the first end of the second contact plate being in permanent contact with a second of the four stationary contacts, the second end of the second contact plate being in contact with a third of the four stationary contacts and being separable from the third stationary contact; and the first contact plate and the second contact plate being adapted to yield and curve convexly in a second direction opposite to the first direction when an external pressure high enough to force the first contact plate and the second contact plate to yield and curve convexly in the second direction is applied to the second contact plate so that the first contact plate contacts a fourth of the four stationary contacts and the second end of the second contact plate separates from the third stationary contact.

2. The thin switch according to claim 1, wherein a recess is formed in one surface of the base, and the four stationary contacts are fixedly arranged in the recess so as to be isolated from each other.

3. The thin switch according to claim 2, wherein an actuator is received in the recess and is movable in the second direction to depress the first and second contact plates, a cover secures the actuator in the recess, and the cover includes a means for holding the cover on the base.

4. The thin switch according to claim 1, wherein the first contact plate and the second contact plate have substantially rectangular shapes, respectively, and mounted on the base so as to extend across each other.

5. The thin switch according to claim 1, wherein the first stationary contact and the first movable contact plate are formed integrally from a single conductive plate, and the second stationary contact and the second movable contact plate are formed integrally from a single conductive plate.

6. A thin switch comprising:

a base;

four stationary contacts arranged on the base and being isolated from each other;

a curved, self-resetting first movable contact plate formed of a conductive spring material, the first contact plate being mounted on the base and curved in a first direction;

a curved, second movable contact plate formed of a conductive spring material, the second contact plate being laid over the first contact plate and being curved in the first direction;

an insulating member interposed between the first contact plate and the second contact plate;

the first contact plate having a first end in permanent contact with a first of the four stationary contacts;

the second contact plate having first and second ends, the first end of the second contact plate being in permanent contact with a second of the four stationary contacts and the second end of the second contact plate separably contacting a third of the four stationary contacts;

the first contact plate and the second contact plate being adapted to yield and curve convexly in a second direction opposite to the first direction when an external pressure high enough to force the first contact plate and the second contact plate to yield and curve convexly in the second direction is applied to the second contact plate so that the first contact plate contacts a fourth of the four stationary contacts and the second end of the second contact plate separates from the third stationary contact.

7. The thin switch according to claim 6, wherein a recess is formed in one surface of the base, and the four stationary contacts are fixedly arranged in the recess so as to be isolated from each other.

8. The thin switch according to claim 7, wherein an actuator is received in the recess and is movable in the second direction to depress the first and second contact plates, a cover secures the actuator in the recess, and the cover includes a means for holding the cover on the base.

9. The thin switch according to claim 6, wherein the first contact plate and the second contact plate have substantially rectangular shapes, respectively, and mounted on the base so as to extend across each other.

10. The thin switch according to claims 6, wherein the first stationary contact and the first movable contact plate are formed integrally from a single conductive plate, and the second stationary contact and the second movable contact plate are formed integrally from a single conductive plate.

* * * * *